United States Patent [19]

Fallier, Jr. et al.

[11] 4,328,446

[45] May 4, 1982

[54] METHOD AND APPARATUS FOR STARTING HIGH INTENSITY DISCHARGE LAMPS

[75] Inventors: Charles N. Fallier, Jr., Westford; Joseph M. Proud, Wellesley, both of Mass.

[73] Assignee: GTE Laboratories Incorporated, Waltham, Mass.

[21] Appl. No.: 139,310

[22] Filed: Apr. 11, 1980

[51] Int. Cl.[3] ..... H01J 7/44; H01J 17/34; H01J 19/78; H01J 29/96

[52] U.S. Cl. ..... 315/47; 315/60; 315/72; 315/73; 315/DIG. 7; 315/74; 315/106; 315/125

[58] Field of Search ..... 315/DIG. 5, DIG. 7, 315/45, 46, 47, 72, 73, 74, 75, 100, 61, 62, 104, 106, 125, 126, 127

[56] References Cited

U.S. PATENT DOCUMENTS

| | | | |
|---|---|---|---|
| 4,001,634 | 1/1977 | Corbley et al. | 315/74 |
| 4,064,416 | 12/1977 | Krense et al. | 315/60 |
| 4,135,114 | 1/1979 | Narikiyo | 315/74 |
| 4,137,483 | 1/1979 | Ochi et al. | 315/74 |
| 4,179,640 | 12/1979 | Larson et al. | 315/DIG. 5 |
| 4,258,288 | 3/1981 | Michael et al. | 315/DIG. 5 |
| 4,277,725 | 7/1981 | Sneijers | 315/73 |

FOREIGN PATENT DOCUMENTS

| | | | |
|---|---|---|---|
| 1496918 | 1/1978 | United Kingdom | 315/104 |

*Primary Examiner*—Saxfield Chatmon, Jr.
*Attorney, Agent, or Firm*—Fred Fisher

[57] ABSTRACT

A high pressure sodium lamp, which includes a discharge tube enclosing xenon at pressures in excess of 300 torr, is reliably started by the combination of an igniter, a conductor wrapped around the discharge tube, and a switching circuit. The igniter provides periodic pulses of 2500 to 4000 volts with a duration of at least one microsecond. The switching circuit provides a high voltage pulse having an amplitude about equal to the amplitude of the periodic pulses and a duration much greater than the duration of the periodic pulses. The conductor intensifies the electric field within the discharge tube. A conventional lamp ballast provides ac power during starting and normal operation.

24 Claims, 4 Drawing Figures

METHOD AND APPARATUS FOR STARTING HIGH INTENSITY DISCHARGE LAMPS

BACKGROUND OF THE INVENTION

This invention relates to starting of high intensity discharge lamps and, more particularly, to methods and apparatus for starting of discharge lamps containing noble gases at pressures in excess of 300 torr.

High intensity discharge lamps such as high pressure sodium lamps commonly include noble gases at pressures below 100 torr. Lamps containing noble gases at pressures below 100 torr can be started and operated by utilizing an igniter in conjunction with a lamp ballast. The igniter provides high voltage, short duration pulses which assist in initiating discharge. The lamp ballast converts the ac line voltage to the proper amplitude and impedance level for lamp operation.

It has been found that the inclusion in high pressure sodium lamps of xenon as the noble gas at pressures well in excess of 100 torr is beneficial to lamp performance. However, the igniter described above does not produce reliable starting at xenon pressures above about 100 torr. A conductor wrapped around the discharge tube and connected to one of the electrodes is described as having been utilized in assisting the starting of a lamp containing xenon at pressures up to 300 torr in U.S. Pat. No. 4,179,640, issued Dec. 18, 1979, to Larsen et al. The lamp is described as having been operated from a conventional ballast and starting pulse generator.

Another arrangement for starting high pressure discharge lamps is shown in U.S. Pat. No. 4,137,483, issued Jan. 30, 1979, to Ochi et al. A switching circuit contained within the lamp induces a high voltage starting pulse. The high voltage pulse operates in conjunction with a conductor wrapped around the discharge tube to initiate discharge in the lamp. The igniter and the conventional ballast are not used.

Recent developments have indicated the desirability of including xenon at pressures in excess of 300 torr in high pressure sodium lamps. However, none of the starting arrangements described above are effective to reliably start lamps having xenon pressures in excess of 300 torr.

SUMMARY OF THE INVENTION

It is a general object of the present invention to provide new and improved methods and apparatus for starting of high intensity discharge lamps.

It is another object of the present invention to provide methods and apparatus for starting of high intensity discharge lamps containing a noble gas or mixtures thereof at pressures in excess of 300 torr.

According to the present invention, these and other objects and advantages are achieved in a light source for use in conjunction with a lamp ballast and an igniter. The light source includes a high pressure discharge lamp which includes a discharge tube having electrodes sealed therein at opposite ends. The discharge tube encloses a noble gas or mixtures thereof at pressures in excess of 300 torr. The igniter provides periodic pulses having an amplitude of about 2500 volts and a duration of about one microsecond to the lamp. The light source further includes a conductor coupled to one of the electrodes and located in close proximity to an outer surface of the discharge tube. The light source further includes pulsing means having outputs coupled to the electrodes for generating at the outputs a high voltage pulse having an amplitude about that of the periodic pulses and a duration much greater than that of the periodic pulses. When the light source is coupled to the lamp ballast and to the igniter, the periodic pulses, the conductor, and the high voltage pulse are operative to initiate a discharge in the lamp. The light source can further include a light transmitting outer envelope surrounding the lamp, the conductor, and the pulsing means, and a lamp base for coupling power through the envelope to the lamp.

For a better understanding of the present invention, together with other and further objects, advantages, and capabilities thereof, reference is made to the following disclosure and appended claims in connection with the above-described drawings.

DESCRIPTION OF THE PREFERRED EMBODIMENTS

Figure 1:
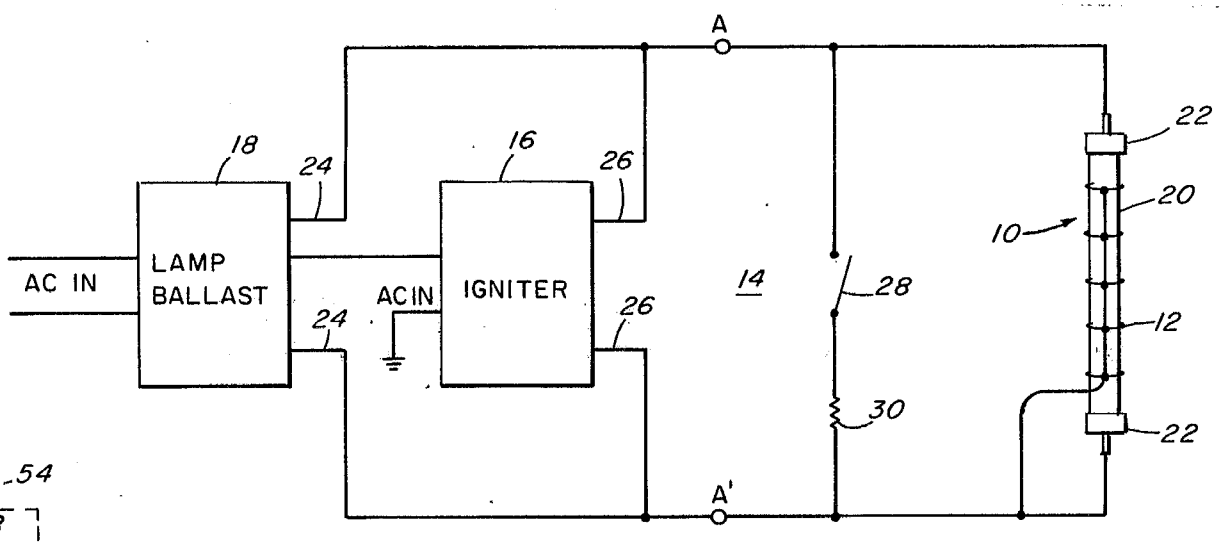
FIG. 1 is a schematic block diagram of a light source according to the present invention.

Referring now to FIG. 1, a light source according to the present invention includes a high intensity discharge lamp 10, a conductor 12, a switching circuit 14, and can include an igniter 16 and a lamp ballast 18. The discharge lamp 10 is a high pressure sodium lamp and includes a discharge tube 20, typically made of alumina or other transparent ceramic material, having electrodes 22 sealed therein at opposite ends. The conductor 12, typically a fine wire, is wrapped around the discharge tube 20 and is coupled to the electrode 22 which is connected to a reference potential such as ground. The lamp ballast 18 receives ac power, typically 115 volts, 60 hertz, at its input and has its outputs 24 connected to the electrodes 22 of the discharge lamp 10. The igniter 16 receives an ac input from an auxiliary output of the lamp ballast 18. Outputs 26 of the igniter 16 are coupled to the electrodes 22 of the discharge lamp 10. The switching circuit 14, as shown, includes a switch 28 and a resistor 30 coupled in series across the electrodes 22 of the discharge lamp 10. The resistor 30 provides current limiting and can be replaced by a short circuit without departing from the scope of the present invention.

The discharge tube 20 encloses a fill material, typically including sodium or a sodium amalgam and a noble gas or mixtures of noble gases, which emit light during discharge. In particular, the inclusion in the discharge tube 20 of xenon at pressures above 300 torr provides superior lamp performance. Lamp ballasts for high intensity discharge lamps are well known in the art and can be of the leading or lagging type. One example of a suitable lamp ballast is General Electric Model No. 17G3202. The lamp ballast 18 is operative to step the ac input voltage up or down depending on the magnitude of the ac input and to provide a relatively high impedance output. The igniter 16, also well known in the art, is operative to provide high amplitude, short duration pulses which assist in initiating discharge in the discharge lamp 10. Pulses appearing at outputs 26 are typically 2500 to 4000 volts in amplitude and at least one microsecond in duration. Furthermore, the pulses occur in timed relation to the ac power, typically being substantially synchronized with the peaks of the ac voltage. The specifications for the pulses produced by the igniter have been standardized by the American National Standards Institute in specification Ansi C 78.1350-1976. One example of a suitable igniter is General Electric Model No. 17G9932.

Figure 2:
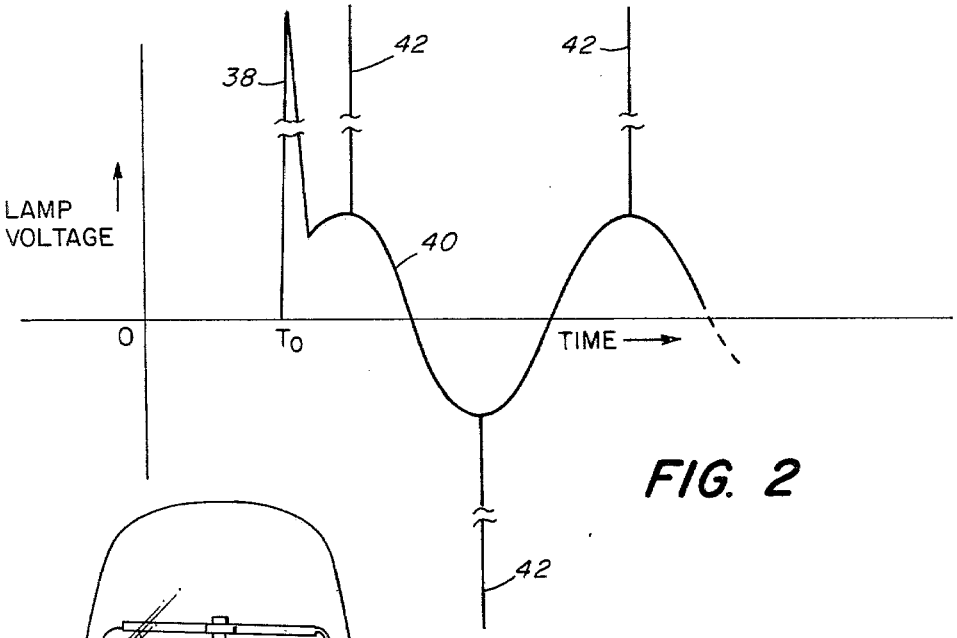
FIG. 2 is a graphic illustration of the voltage wave form applied to the electrodes of the discharge lamp shown in FIG. 1.

The combination of the conductor 12, the switching circuit 14, and the igniter 16 form a starting circuit which is operative to initiate discharge in the discharge lamp 10 while the lamp ballast 18 provides ac power on a continuous basis during starting and normal operation. The initiation of a discharge in the lamp 10 can be described as follows with reference to FIG. 2. Assume in the present example that the ac power is applied prior to the opening of the switch 28 and that the resistor 30 has a very small value. Thus, the lamp voltage remains approximately zero until time $T_o$ when the switch 28 is opened. The opening of the switch 28 causes an inductively generated high voltage pulse 38 to be applied to the lamp. After the opening of the switch 28, the lamp ballast 18 provides at the outputs 24 an ac voltage 40, typically 180 volts ac for a 400 watt high pressure sodium lamp. At the same time, the igniter 16 provides at its outputs 26 periodic pulses 42 having an amplitude of 2500 to 4000 volts and a duration of at least one microsecond. The periodic pulses 42 are substantially synchronized with the peaks of the ac voltage 40. Lead circuit ballasts require one pulse per half cycle of the ac voltage, as shown in FIG. 2, while lag circuit ballasts require one pulse per cycle of the ac voltage. After the discharge is established and the lamp 10 is fully warmed up, the current drawn by the lamp 10 reduces the ac output voltage 40 of the lamp ballast 18 and periodic pulses 42 are no longer provided.

As noted above, the high voltage pulse 38 is generated when the switch 28 is opened. Typical lamp ballasts 18 include transformers and have highly inductive output impedances. Prior to the time $T_o$, a substantial current is drawn from the lamp ballast 18 through the switch 28 and the resistor 30. When the switch 28 is opened, the current drawn from the lamp ballast 18 rapidly decreases and the inductive output of the lamp ballast 18 generates the high voltage pulse 38. The energy provided by the high voltage pulse 38, in combination with the periodic pulses 42 and the conductor 12, is sufficient to form a discharge in the discharge lamp 10. For optimum lamp starting, the high voltage pulse 38 has an amplitude approximately equal to the amplitude of the periodic pulses 42 and a duration much greater than the duration of the periodic pulses 42. The high voltage pulse 38 is typically about 100 microseconds in duration.

The effect of the conductor 12 around the discharge tube 20 is to provide electric field distortion such that the electric field near the electrodes 22 is intensified within the discharge tube. The development of ionization in this region is thought to spread progressively along the inside surface of the discharge tube 20 until a continuous path of ionization is produced between the two electrodes 22. When an ionization path is formed in which electron densities and temperatures are sufficiently elevated, the path is relatively highly conductive. At xenon pressures below 300 torr, the ionization path absorbs additional power and increases in conductivity until an arc discharge is formed and the lamp has been started. However, at xenon pressures in excess of 300 torr, the initial ionization path does not absorb additional power and arc formation does not occur in the absence of the switching circuit 14.

The voltage levels in the ballast system must not exceed the rated values, typically about 2500 volts for standard high pressure sodium lamp ballasts. The amplitude of the high voltage pulse 38 is given by L di/dt where L is the output inductance of the lamp ballast, di is the change in current when the switch 28 is opened, and dt is the time required for di to occur. Thus, the amplitude of the pulse can be controlled either by controlling the current through the switch 28 or by controlling the speed at which the switch 28 opens. It is possible to limit the current through the switch 28 by the series resistance 30. Effective starting can be achieved when series resistance values of 100 ohms or more are utilized.

It will be obvious to those skilled in the art that the circuit shown in FIG. 1 is but one way of generating the high voltage pulse 38. Any suitable high voltage pulse generating circuit can be utilized. Furthermore, the duration of the high voltage pulse 38 applied to the lamp 10 is not critical provided the pulse has a duration which is long in relation to the periodic pulses 42. It is to be understood that, while the configuration shown in FIG. 1 is most useful to start and operate high intensity lamps containing noble gases at pressures in excess of 300 torr, it can also be used to start and operate lamps containing noble gases at lower pressure.

Figure 3:
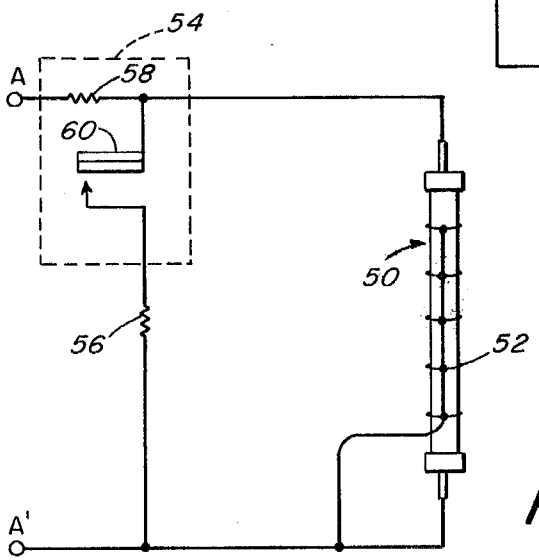
FIG. 3 is a schematic diagram of a preferred embodiment of a light source according to the present invention.
Figure 4:
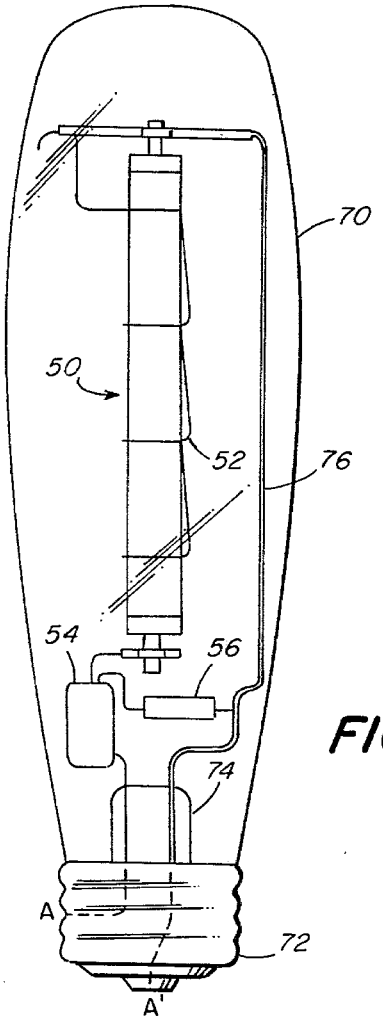
FIG. 4 is an illustration of the physical configuration of the light source shown in FIG. 3.

Referring now to FIGS. 3 and 4, there is shown a light source according to the present invention which provides automatic starting. The light source includes a discharge lamp 50, a conductor 52, a thermal switch 54, and a current limiting resistor 56, which are to be used in conjunction with a lamp ballast and an igniter. The lamp circuit shown in FIG. 3 can replace the lamp 10, the conductor 12, and the switching circuit 14 in FIG. 1 by connecting the points labelled A and A′ in FIG. 3. to the points A and A′, respectively, in FIG. 1. The discharge lamp 50 shown in FIG. 3 corresponds to the discharge lamp 10 shown in FIG. 1 and is a high pressure sodium lamp including xenon or other noble gases at pressures in excess of 300 torr. The conductor 52 is typically a fine wire and is wrapped around the discharge tube and is connected to one electrode of the discharge lamp 50. The thermal switch 54 includes a heater resistor 58 and a bimetal switch 60 connected in series. The inputs A and A′ from the lamp ballast and the igniter are coupled through the heater resistor 58 to the electrodes of the discharge lamp 50. The bimetal switch 60 and the current limiting resistor 56 are coupled in series across the electrodes of the discharge lamp 50.

In operation, the lamp ballast provides ac power to the points A and A′ and the igniter provides periodic pulses of high amplitude and short duration to the points A and A′ as described hereinabove. Also, the conductor 52 promotes the formation of an ionization path within the discharge lamp 50 as described hereinabove. In a cold condition, the bimetal switch 60 is closed. Therefore, when power is applied to the points A and A′, current flows through the resistor 58, the bimetal switch 60, and the resistor 56. The heater resistor 58 is placed in close proximity to the bimetal switch so that heat generated by current passing therethrough will heat the bimetal switch 60. After a predetermined time, the heat generated by the resistor 58 causes the bimetal switch 60 to switch to the open position and the current drawn from the ballast is rapidly decreased. The rapid decrease is current drawn from the ballast causes the highly inductive output of the ballast to generate a high voltage pulse which provides sufficient energy to initiate discharge in the lamp 50 as hereinabove described and shown in FIG. 2. The current drawn by the discharge lamp 50 through the resistor 58 causes the resistor 58 to remain heated and the bimetal switch 60 to remain in the open position. If for some reason, the discharge lamp 50 does not start when the bimetal switch 60 opens, no current is drawn through the resistor 58 and the bimetal switch 60 cools until it recloses. Heating of the resistor 58 again occurs, causing the bimetal switch 60 to open and another high voltage starting pulse is generated. Thus, the starting process is repeated until a discharge is initiated in the lamp 50.

FIG. 4 depicts a configuration of the light source shown in FIG. 3 which facilitates replacement of standard high pressure sodium lamps with lamps containing xenon at pressures in excess of 300 torr. Thus, high pressure sodium lamps having the improved performance characteristics provided by high pressure xenon can be operated directly from existing lamp ballasts and igniters. The discharge lamp 50, the conductor 52, the thermal switch 54, and the current limiting resistor 56 are mounted within a light transmitting outer envelope 70 which can be glass. The elements are connected electrically as shown in FIG. 3 and described hereinabove. AC power and periodic pulses are received by a standard lamp socket 72 and are coupled through a lamp stem 74 to the lamp circuit shown in FIG. 3. The outer envelope 70 can have any convenient shape. The discharge lamp 50 is supported within the outer envelope 70 by a rigid frame 76. The construction of the outer envelope 70, the lamp base 72, and the frame 76 are well known in the art. The conductor 52 is wrapped around the discharge lamp 50 and is coupled to one of the electrodes of the discharge lamp 50. A fine wire is used to minimize light blockage. The thermal switch 54 and the current limiting resistor 56 are preferably located below the discharge lamp 50 in order to minimize light blockage by these elements.

While there has been shown and described what is at present considered the preferred embodiments of the invention, it will be obvious to those skilled in the art that various changes and modifications may be made therein without departing from the scope of the invention as defined by the appended claims.

What is claimed is:

1. A light source for use in conjunction with a lamp ballast which provides ac power and which includes an inductive output and an igniter which provides periodic pulses having an amplitude of 2500 to 4000 volts and a duration of at least one microsecond, and periodic pulses being substantially synchronized with peaks of the ac power, said light source comprising:

a high pressure discharge lamp including a discharge tube having electrodes sealed therein at opposite ends and enclosing a noble gas or mixtures thereof having a pressure of greater than 300 torr;

a conductor, coupled to one of said electrodes and located in close proximity to an outer surface of said discharge tube; and pulsing means, having outputs coupled to said electrodes, for generating at said outputs a high voltage pulse having an amplitude about that of said periodic pulses and a duration much greater than that of said periodic pulses, whereby, when said light source is coupled to the lamp ballast and to said igniter, said periodic pulses, said conductor, and said high voltage pulse are operative to initiate a discharge in said lamp.

2. The light source as defined in claim 1 wherein said pulsing means includes switching means, having an input for receiving current from the ballast, for drawing a current from the ballast is one switching state and for rapidly reducing the current drawn from the ballast in an opposite switching state, whereby the inductive output of the ballast is operative, when the current drawn therefrom is rapidly reduced, to provide said high voltage pulse to said discharge lamp.

3. The light source as defined in claim 2 wherein said switching means includes means for switching from said one switching state to said opposite switching state at a predetermined time after said ac power is applied to said light source.

4. The light source as defined in claim 2 wherein said conductor includes a fine wire to reduce light blockage.

5. The light source as defined in claim 4 wherein said fine wire is coupled to a reference potential.

6. The light source as defined in claim 4 wherein said noble gas includes xenon.

7. The light source as defined in claim 6 wherein said discharge lamp is a high pressure sodium lamp.

8. The light source as defined in claim 7 further including a light transmitting outer envelope surrounding said lamp, said conductor, and said pulsing means and a lamp base for coupling power through said envelope to said lamp.

9. A light source for receiving ac power from a lamp ballast which includes an inductive output, said light source comprising:

a high pressure discharge lamp including a discharge tube having electrodes sealed therein at opposite ends; and a starting circuit for initiating discharge in said lamp, said starting circuit including first pulsing means, having outputs coupled to said electrodes, for generating at said outputs periodic pulses having an amplitude of 2500 to 4000 volts and a duration of at least one microsecond, said periodic pulses being substantially synchronized with peaks of the ac power, a conductor, coupled to one of said electrodes and located in close proximity to an outer surface of the discharge tube, and second pulsing means, having outputs coupled to said electrodes, for generating at said outputs a high voltage pulse having an amplitude about that of said periodic pulses and a duration much greater than that of said periodic pulses, whereby said periodic pulses, said conductor, and said high voltage pulse are operative to initiate a discharge in said lamp.

10. The light source as defined in claim 9 wherein said second pulsing means includes switching means, having an input for receiving current from the ballast, for drawing a current from the ballast in one switching state and for rapidly reducing the current drawn from the ballast in an opposite switching state, whereby the inductive output of the ballast is operative, when the current drawn therefrom is rapidly reduced, to provide said high voltage pulse to said discharge lamp.

11. The light source as defined in claim 10 wherein said switching means includes means for switching from said one switching state to said opposite switching state at a predetermined time after said ac power is applied to said light source.

12. The light source as defined in claim 9 wherein said lamp includes a noble gas or mixtures thereof having a pressure of at least 300 torr.

13. The light source as defined in claim 12 wherein said lamp includes high pressure xenon.

14. The light source as defined in claim 13 wherein said discharge lamp is a high pressure sodium lamp.

15. The light source as defined in claim 10 wherein said conductor includes a fine wire to reduce light blockage.

16. The light source as defined in claim 15 wherein said fine wire is coupled to a reference potential.

17. A light source comprising:

a high pressure discharge lamp including a discharge tube having electrodes sealed therein at opposite ends;

first pulsing means, having outputs coupled to said electrodes, for generating at said outputs periodic pulses having an amplitude of 2500 to 4000 volts and a duration of at least one microsecond;

a conductor, coupled to one of said electrodes and located in close proximity to an outer surface of the discharge tube;

second pulsing means, having outputs coupled to said electrodes, for generating at said outputs a high voltage pulse having an amplitude about that of said periodic pulses and a duration much greater than that of said periodic pulses; and lamp ballast means, coupled to said electrodes, for converting ac input power to a level and impedance suitable for operation of said discharge lamp, whereby said periodic pulses, said conductor, and said high voltage pulse are operative to initiate a discharge in said lamp.

18. A method for initiating discharge in a high pressure discharge lamp which receives ac power from a lamp ballast, said lamp comprising a discharge tube having electrodes sealed therein at opposite ends, said method comprising the steps of:

supplying to said electrodes periodic pulses having an amplitude of 2500 to 4000 volts and a duration of at least one microsecond, said periodic pulses being substantially synchronized with peaks of the ac power;

locating a conductor in close proximity to an outer surface of said discharge tube and coupling the conductor to one of said electrodes; and supplying to said electrodes a high voltage pulse having an amplitude about that of said periodic pulses and a duration much greater than that of said periodic pulses.

19. The method as defined in claim 18 wherein the ballast includes a inductive output and the step of supplying a high voltage pulse includes the steps of:

drawing a current from the ballast and thereafter, rapidly reducing the current drawn from the ballast whereby the inductive output of the ballast is operative, when the current drawn therefrom is rapidly reduced, to provide said high voltage pulse to said discharge lamp.

20. The method as defined in claim 18 wherein said lamp includes a high pressure noble gas or mixtures thereof having a pressure of at least 300 torr.

21. The method as defined in claim 20 wherein said noble gas includes xenon.

22. The method as defined in claim 21 wherein said discharge lamp is a high pressure sodium lamp.

23. The method as defined in claim 18 wherein said conductor includes a fine wire to reduce light blockage.

24. The method as defined in claim 23 wherein the step of locating a conductor further includes the step of coupling the conductor to a reference potential.

* * * * *